US010424269B2

(12) United States Patent
Chen et al.

(10) Patent No.: US 10,424,269 B2
(45) Date of Patent: Sep. 24, 2019

(54) FLEXIBLE ADDRESSING FOR A THREE DIMENSIONAL (3-D) LOOK UP TABLE (LUT) USED FOR GAMUT MAPPING

(71) Applicant: ATI TECHNOLOGIES ULC, Markham (CA)

(72) Inventors: Yuxin Chen, Markham (CA); David Glen, Markham (CA); Yee Shun Chan, Markham (CA)

(73) Assignee: ATI Technologies ULC, Markham (CA)

( * ) Notice: Subject to any disclaimer, the term of this patent is extended or adjusted under 35 U.S.C. 154(b) by 0 days.

(21) Appl. No.: 15/388,663

(22) Filed: Dec. 22, 2016

(65) Prior Publication Data

US 2018/0182353 A1 Jun. 28, 2018

(51) Int. Cl.

| | |
|---|---|
| ***G09G 5/06*** | (2006.01) |
| ***G09G 5/02*** | (2006.01) |
| ***G09G 5/397*** | (2006.01) |

(52) U.S. Cl.

CPC ..... *G09G 5/06* (2013.01); *G09G 5/022* (2013.01); *G09G 5/026* (2013.01); *G09G 5/397* (2013.01); *G09G 2320/0666* (2013.01); *G09G 2340/06* (2013.01)

(58) Field of Classification Search

CPC ... G09G 5/06; G09G 5/022; G09G 2320/0666
See application file for complete search history.

(56) References Cited

U.S. PATENT DOCUMENTS

| | | | | |
|---|---|---|---|---|
| 5,943,058 | A * | 8/1999 | Nagy | G06T 15/04 345/582 |
| 7,701,465 | B2 * | 4/2010 | Suzuki | H04N 1/6058 345/600 |
| 2004/0215870 | A1 | 10/2004 | Chow et al. | |
| 2004/0246268 | A1 | 12/2004 | Nair et al. | |
| 2008/0068861 | A1 | 3/2008 | Lin et al. | |
| 2011/0012920 | A1 | 1/2011 | Saigo et al. | |
| 2013/0093783 | A1 | 4/2013 | Sullivan et al. | |
| 2015/0100612 | A1 | 4/2015 | Lee et al. | |
| 2015/0179135 | A1 | 6/2015 | Stauder et al. | |
| 2016/0057454 | A1 | 2/2016 | Bordes et al. | |
| 2016/0062954 | A1 | 3/2016 | Ruff et al. | |

(Continued)

OTHER PUBLICATIONS

Lee et al., A Real Time Color Gamut Mapping Using Tetrahedral Interpolation for Digital TV Color Reproduction Enhancement, 2009, IEEE, 0098 3063/09, pp. 599-605 (Year: 2009).*

(Continued)

*Primary Examiner* — Samantha (Yuehan) Wang

(57) ABSTRACT

A three-dimensional (3-D) look up table (LUT) can be accessed using an address decoder to identify a plurality of vertices in the 3-D LUT based on a number (m) of most significant bits (MSBs) of three coordinate values representative of a first color and a non-zero integer (p). The three coordinate values are determined by a source gamut. One or more memories store component values representative of a plurality of second colors determined by a destination gamut. The component values are stored at memory locations associated with the plurality of vertices. An interpolator maps the input color to an output color in the destination gamut based on the component values.

17 Claims, 11 Drawing Sheets

(56) References Cited

U.S. PATENT DOCUMENTS

| | | | |
|---|---|---|---|
| 2016/0117967 | A1 | 4/2016 | Buckley et al. |
| 2016/0322024 | A1 | 11/2016 | Stauder et al. |
| 2017/0092229 | A1 | 3/2017 | Greenbaum et al. |
| 2017/0256039 | A1 | 9/2017 | Hsu et al. |

OTHER PUBLICATIONS

Lee, Hak-Sung, et al., "A Real Time Color Gamut Mapping Using Tetrahedral Interpolation for Digital TV Color Reproduction Enhancement". IEEE Transactions on Consumer Electronics, vol. 55, No. 2, May 2009, 7 pages.

Notice of Allowance dated May 23, 2018 for U.S. Appl. No. 15/442,259, 14 pages.

Notice of Allowance dated Jul. 25, 2018 for U.S. Appl. No. 15/442,259, 16 pages.

U.S. Appl. No. 15/442,259, filed Feb. 24, 2017 in the name of Yuxin Chen.

U.S. Appl. No. 15/469,299, filed Mar. 24, 2017 in the name of Yuxin Chen et al.

Notice of Allowance dated May 23, 2018 for U.S. Appl. No. 15/388,663, 37 Pages.

Bae, Yoonsung, et al., "Gamut-Adaptive Correction in Color Image Processing." Proceedings of 2010 IEEE 17th International Conference on Image Processing, Sep. 26-29, 2010, 4 pages.

Braun, Gustav, et al., "Color Gamut Mapping in a Hue-Linearized CIELAB Color Space." Rochester Institute of Technology, RIT Scholar Works, 1998, 7 pages.

Han, Dongil, "A Cost Effective Color Gamut Mapping Architecture for Digital TV Color Reproduction Enhancement." IEEE Transactions on Consumer Electronics, vol. 51, No. 1, Feb. 1, 2005, 7 pages.

Han, Dongil, "Real-Time Color Gamut Mapping Method for Digital TV Display Quality Enhancement." IEEE Transactions on Consumer Electronics, vol. 50, No. 2, May 2004, 9 pages.

Laird, Justin, et al., "Development and Evaluation of Gamut Extension Algorithms." Color Research and Application, vol. 34, No. 6, Dec. 2009, 9 pages.

Lee, K.Y., et al., "General Chromaticity Compression Function for Gamut Mapping." Electronics Letters, vol. 43, No. 5, Mar. 1, 2007, 2 pages.

Luo, M.R., et al., "CIECAM02 and Its Recent Developments." Advanced Color Image Processing and Analysis, Chapter 2, 2013, 41 pages.

Moroney, Nathan, et al., "Field Trials of the CIECAM02 Color Appearance Model." Hewlett-Packard, website: http://www.hpl.hp.com/personal/Nathan_Moroney/cie-2003-moroney.pdf, retrieved Mar. 24, 2017.

Morovic, Jan, et al., "Calculating Medium and Image Gamut Boundaries for Gamut Mapping." Color and Research Application, vol. 25, Issue 6, Dec. 2000, 8 pages.

Yang, C.C., et al., "Efficient Gamut Clipping for Color Image Processing Using LHS and YIQ." Society of Photo-Optical Engineers, vol. 42, No. 3, Mar. 2003, 11 pages.

Final Office Action dated Feb. 21, 2019 for U.S. Appl. No. 15/439,299, 12 pages.

Notice of Allowance dated Dec. 4, 2018 for U.S. Appl. No. 15/442,259, 13 pages.

Non-Final Office Action dated Oct. 5, 2018 for U.S. Appl. No. 15/469,299, 10 pages.

* cited by examiner

FLEXIBLE ADDRESSING FOR A THREE DIMENSIONAL (3-D) LOOK UP TABLE (LUT) USED FOR GAMUT MAPPING

BACKGROUND

Display devices are used to view images produced by digital processing devices such as desktop computers, laptop computers, televisions, mobile phones, smart phones, tablet computers, digital cameras, and other devices. A wide variety of technologies including cathode-ray tubes (CRTs), liquid crystal displays (LCDs), plasma display panels, and organic light emitting diodes (OLEDs) are used to implement display devices. Consequently, different display devices are able to represent colors within different gamuts. As used herein, the term "gamut" refers to a complete subset of colors that can be accurately represented by a particular display device. The gamuts for two different display devices have the following three possible relationships:

1. Gamut 1 is larger than gamut 2, e.g., some colors that can be displayed in device 1 cannot be displayed in device 2.
2. Gamut 1 is smaller than gamut 2, e.g., all colors that can be displayed in device 1 can also be displayed in device 2.
3. Gamut 1 partially overlaps with gamut 2.

Furthermore, the same color, as perceived by the human eye, can be represented by different numerical values in different gamuts. For example, the RGB color system is commonly used in computer graphics to represent colors of pixels in images. The same color might be represented by different RGB values in different gamuts. Consequently, gamut mapping is used to map color values between different gamuts so that the perceived colors generated using the color values are the same in different devices. However, the RGB color system is not perceptually linear so that changes in the colors perceived by the human visual system are not proportional to changes in the RGB values. Other commonly used color systems including the HLS, HSV, and YIQ color systems are also perceptually non-linear. At least in part because of the perceptual nonlinearity of color systems, gamut mapping is difficult to perform in perceptually non-linear color systems.

Gamut mapping is more straightforward in color systems that are perceptually uniform. As used herein, the phrase "perceptually uniform" refers to a color system in which uniform changes in the components of the color space defined by the color system correspond to uniform changes in perceived color. Relative perceptual differences between colors in a perceptually uniform color system are approximated by treating each color as a point in a three-dimensional (3-D) space and taking the Euclidean distance between the points that represent the two colors. For example, the CIELAB color system is almost perceptually uniform. There are other advanced color systems, such as CIECAM02, which are even more perceptually uniform than CIELAB. Gamut mapping of perceptually non-linear color systems (such as RGB) can therefore be performed by transforming the color values from the perceptually non-linear color system to a perceptually uniform color system (such as CIELAB) and then performing gamut mapping in the perceptually uniform color system. Gamut mapped values of the pixels are then transformed from the perceptually uniform color system back to the perceptually nonlinear color system (such as RGB). Gamut mapping by transformation into perceptually uniform color systems therefore incurs significant computational overhead.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

Figure 1:
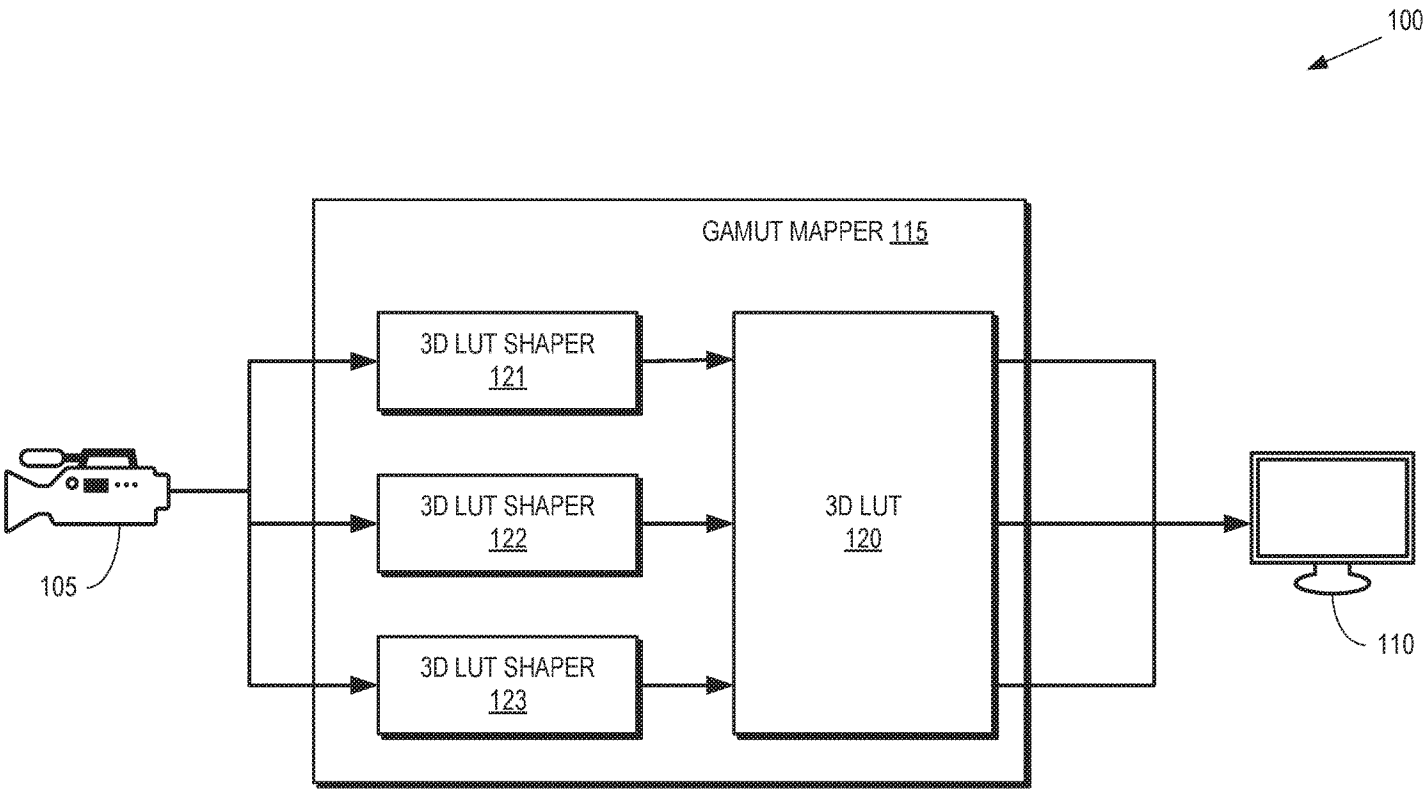
FIG. 1 is a block diagram of an image acquisition and display system according to some embodiments.

The color mapping between two gamuts is conventionally performed using a 3-D look up table (LUT). For example, the three dimensions in the 3-D LUT correspond to the R, G, and B values that represent a pixel color in a source gamut and vertices in the 3-D LUT are associated with the RGB values that represent the same pixel color in a destination gamut. Interpolation is used to compute color component values in the destination gamut for arbitrary RGB values in the source gamut. For example, tetrahedral interpolation can be used to compute color component values for an RGB value based on the color component values of four vertices that define a volume that bounds the RGB value in the tetrahedron. The address decoder of a conventional 3-D LUT uses a subset of the most significant bits (MSBs) of the input RGB value to identify the corresponding vertex in the 3-D LUT. Consequently, the number of samples along each of the three dimensions of the 3-D LUT are constrained to $(2^m+1)$, where m is the number of MSBs used by the address decoder to identify the vertices in the 3-D LUT. Increasing the number of samples improves the quality of the interpolation, but it also rapidly increases the size of the 3-D LUT. For example, if m=4 for all three dimensions of the 3-D LUT, the total number of vertices in the 3-D LUT is 4913. Increasing the number of samples and the number of MSBs used by the address decoder to m=5 increases the total number of vertices in the 3-D LUT to 35,937.

Flexible addressing provides finer granularity in the total number of vertices in a 3-D LUT used to transform between a source gamut and a destination gamut. To implement flexible addressing, a number of samples along each dimension of the 3-D LUT is defined by a number (m) of MSBs of values of input colors in source gamut and a non-zero integer (p). For example, the number of samples along each dimension of the 3-D LUT can be defined as $(2^m+1+4p)$. The non-zero integer (p) satisfies the relation $(2^m+1+4p)>0$. The following disclosure assumes that the number of samples along each dimension of the 3-D LUT is the same. However, in some embodiments, the number of samples along different dimensions of the 3-D LUT can be different.

An address decoder identifies a vertex in the 3-D LUT based on m MSBs of the value of the input color and a correction factor determined based on the non-zero integer (p). In some embodiments, samples of component values of the color in the destination gamut are stored in four memories that can be accessed concurrently. The samples are ordered such that each of four vertices used for tetrahedral interpolation of any input value are stored in different memories. The address decoder is configured to identify the vertices used for interpolation based on the correction factor and a counter value that is determined by the input value and the number (m) of MSBs. In some embodiments, the input values are provided to a 3-D LUT shaper, which is configured to modify the input values to account for the differing sensitivity of human perception to differences between lighter and darker tones. Component values of the source gamut color are scaled by a factor determined by the value of the non-zero integer (p), relative to the component values in a conventional 3-D LUT. For example, the component values can be scaled by a factor:

$$\lambda = 1 + \frac{p}{2^{m-2}}$$

For example, if m=4 and p=−1, the scale factor λ=3/4 and the LUT shaper compresses the component values by a ratio of 3/4.

FIG. 1 is a block diagram of an image acquisition and display system 100 according to some embodiments. The image acquisition and display system 100 includes an image acquisition device 105 that acquires or generates images for display on a display 110. Some embodiments of the image acquisition device 105 are cameras that acquire images (including video images in some cases) of a scene in a digital format. Other embodiments of the image acquisition device 105 are processing systems that are able to generate images (including video images in some cases) for presentation on the display 110. For example, the image acquisition device 105 can include a graphics processing system such as a gaming system that generates images for presentation on the display 110.

The images that are acquired or generated by the image acquisition device 105 are represented by values of pixels. The pixel values are binary numbers that indicate colors produced by the pixels according to a color system that defines a gamut of colors. For example, the pixel values can include three binary numbers that indicate Red, Green, and Blue components of the color produced by each pixel. The display 110 uses the pixel values to determine the color that is generated by each pixel to produce the image that is displayed on the display 110. The display 110 interprets the pixel values in terms of a gamut implemented by the display 110. However, as discussed herein, the gamut used by the image acquisition device 105 to acquire/generate images is not necessarily the same as the gamut used by the display 110 to present the images to a user. Furthermore, different displays can implement different gamuts.

The image acquisition and display system 100 includes a gamut mapper 115 to map pixel values produced by the image acquisition device 105 according to a first gamut to pixel values used by the display 110 to present images to a user according to a second gamut. The gamut mapper 115 includes (or has access to) a 3-D LUT 120 that stores samples of color values in the second gamut corresponding to color values in the first gamut. The 3-D LUT 120 is represented as a lattice having three dimensions that correspond to three color components in the first gamut. For example, the 3-D LUT 120 can be represented as a lattice having a first dimension corresponding to the Red color component, a second dimension corresponding to the Green color component, and a third dimension corresponding to the Blue color component. Each vertex in the 3-D LUT 120 is associated with a sample of color values in the second gamut that correspond to the color values in the first gamut. For example, the color component values $(R_1, G_1, B_1)$ in the first gamut map to a vertex in a lattice of the 3-D LUT 120 that is associated with corresponding color component values $(R_2, G_2, B_2)$ in the second gamut.

The vertices in a conventional 3-D LUT are addressed using a subset of the most significant bits (MSBs) of the input RGB value to identify the corresponding vertex in the 3-D LUT. Consequently, the number of samples along each of the three dimensions of the 3-D LUT are constrained to $(2^m+1)$, where m is the number of MSBs used to identify the vertices in the 3-D LUT. Increasing the number of samples improves the quality of the interpolation, but it also rapidly increases the size of the 3-D LUT, as shown in Table 1.

TABLE 1

| Bits (m) in each dimension | Total number of samples/ vertices in 3-D LUT | |
|---|---|---|
| 3 | 9 × 9 × 9 | 729 |
| 4 | 17 × 17 × 17 | 4813 |
| 5 | 33 × 33 × 33 | 35937 |
| 6 | 65 × 65 × 65 | 274625 |

Addressing the vertices in the conventional 3-D LUT using only the MSBs of the input color components significantly limits the possible granularities for sampling the color components used to produce the conventional 3-D LUT. Furthermore, hardware implementations of the conventional 3-D LUT require very large memories to store samples when the number of bits (m) becomes large.

At least in part to address these drawbacks with implementations of the conventional 3-D LUT, the 3-D LUT 120 shown in FIG. 1 is generated by sampling the color components in the second gamut at color component values in the first gamut that are determined based on a number (m) of most significant bits (MSBs) of the color component values and a non-zero integer (p). The sampled values of the color components in the second gamut are associated with vertices in the 3-D LUT 120 corresponding to the values of the color components in the first gamut. The number of vertices along each dimension of the 3-D LUT 120 is therefore equal to $(2^m+1+4p)$. The value of the non-zero integer (p) can be positive or negative as long as the non-zero integer (p) satisfies the requirement that $(2^m+1+4p)>0$, which indicates that there is at least one sample along each dimension of the 3-D LUT 120. Determining the number of samples along each dimension based in part on the value of the non-zero integer (p) increases the potential granularities of the 3-D LUT 120.

Table 2 illustrates the total number of samples or vertices in the 3-D LUT 124 different values of value of the non-zero integer (p) and three different configurations:

1. p is a non-positive value and $p>-2^{m-2}$
2. p is a non-negative value and $p<2^{m-2}$
3. p is an integer value with m=4 and $p>-2^{m-2}-1/4$ Thus, the same number of samples or vertices in the 3-D LUT 120 can be produced using different combinations of the number (m) of MSBs and values of the non-zero integer (p).

TABLE 2

| Configuration 1 | | Configuration 2 | | Configuration 3 | | Total number of samples/ vertices in 3-D LUT | |
|---|---|---|---|---|---|---|---|
| m | p | m | p | m | p | | |
| 3 | 0 | 3 | 0 | 4 | −2 | 9 × 9 × 9 | 729 |
| 4 | −1 | | 1 | | −1 | 13 × 13 × 13 | 2197 |
| | 0 | 4 | 0 | | 0 | 17 × 17 × 17 | 4913 |
| 5 | −3 | | 1 | | 1 | 21 × 21 × 21 | 9261 |
| | −3 | | 2 | | 2 | 25 × 25 × 25 | 15625 |
| | −1 | | 3 | | 3 | 29 × 29 × 29 | 24389 |
| | 0 | 5 | 0 | | 4 | 33 × 33 × 33 | 35937 |
| 6 | −7 | | 1 | | 5 | 37 × 37 × 37 | 50563 |
| | −6 | | 2 | | 6 | 41 × 41 × 41 | 68921 |
| | −5 | | 3 | | 7 | 45 × 45 × 45 | 91125 |
| ... | ... | ... | ... | ... | ... | ... | ... |

Vertices in the 3-D LUT 120 can therefore be identified based on the number (m) of most significant bits (MSBs) of the color component values and the non-zero integer (p). Values of the color coordinates in the second gamut can then be retrieved from memory locations associated with the vertices of the 3-D LUT 120. As discussed herein, the values of the color components in the second gamut retrieved from the 3-D LUT 120 are used to map input colors (in the first gamut) to an output color in the second gamut based on the retrieved values of the color components in the second gamut. For example, interpolation techniques such as tetrahedral interpolation can be used to interpolate from values of the color components at the vertices of the 3-D LUT 120 to a value of the color components in the second gamut at the location indicated by the color coordinates in the first gamut.

Sampling of the 3-D LUT 120 and interpolation based on the sampled values are linear processing techniques, whereas human perception is nonlinear, e.g., the human eye is more sensitive to relative differences between darker tones and lighter tones. Shaping of the input values of the color components is therefore used to account for the nonlinearity of human perception. In the illustrated embodiment, the gamut mapper 115 includes 3-D LUT shapers 121, 122, 123 (collectively referred to herein as "the 3-D LUT shapers 121-123") that perform shaping of the values of the input color components. For example, the 3-D LUT shaper 121 shapes the value of the Red component, the 3-D LUT shaper 122 shapes the value of the Green component, and the 3-D LUT shaper 123 shapes the value of the Blue component. Some embodiments of the 3-D LUT shapers 121-123 apply a scaling factor to the input color components. For example, the component values can be scaled by a factor:

$$\lambda = 1 + \frac{p}{2^{m-2}}$$

Figure 2:
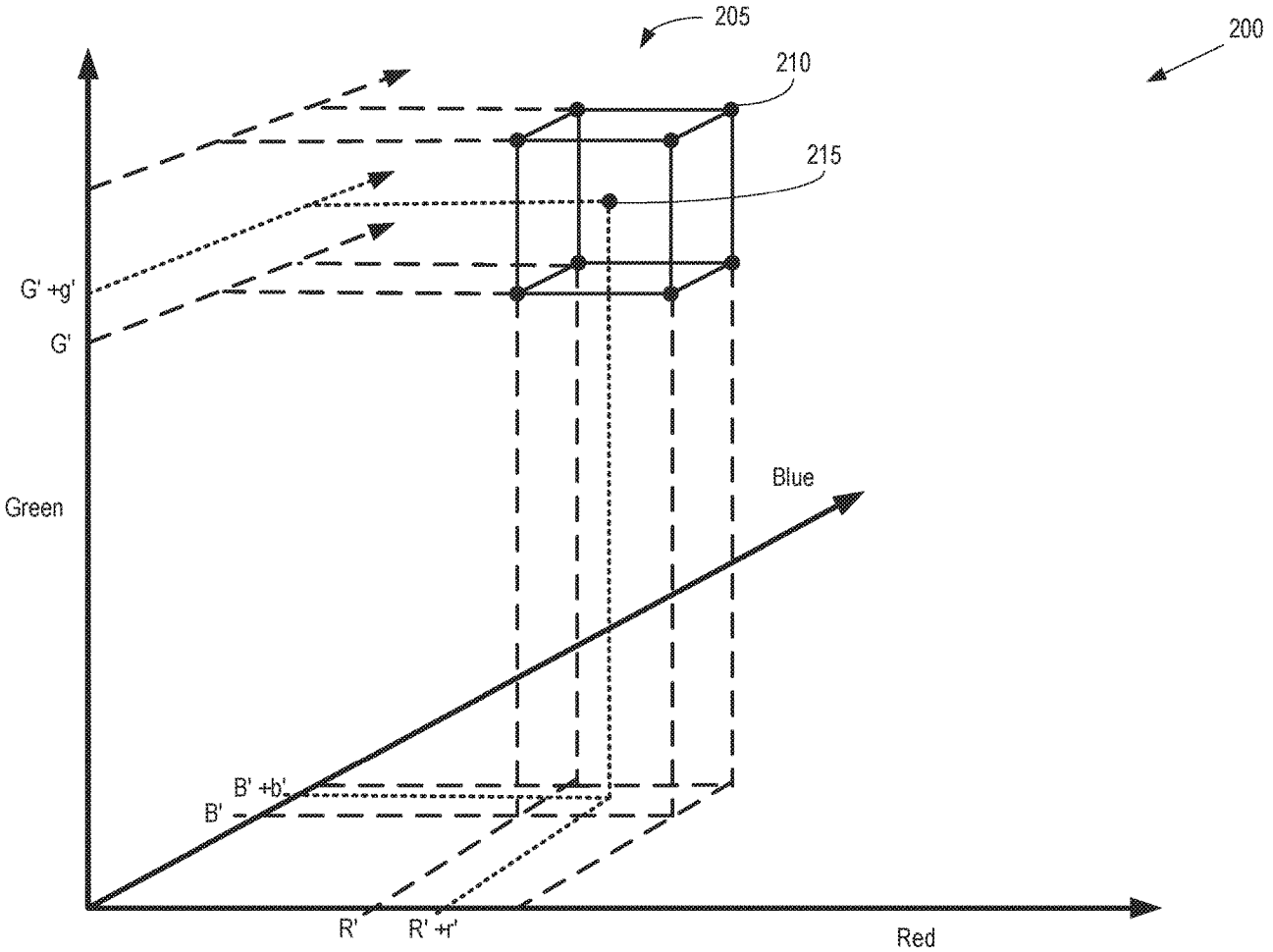
FIG. 2 is a diagram of a portion of a lattice that represents a 3-D LUT according to some embodiments.

FIG. 2 is a diagram of a portion 200 of a lattice that represents a 3-D LUT according to some embodiments. In the interest of clarity, a single cube 205 from the lattices shown in the portion 200. The cube 205 is defined by a set of vertices 210 (only one indicated by a reference numeral in the interest of clarity) in the lattice. Each vertex 210 is addressed or identified by color component values in a first gamut. For example, the portion 200 of the lattice is defined in an RGB color space so that the three axes of the 3-D LUT correspond to the Red, Green, and Blue color components. The vertex 210 is then identified based on the color component values (R', G', B'). In a conventional 3-D LUT, the color component values (R', G', B') are equal to a value indicated by a number (m) of MSBs of the complete color component value corresponding to the vertex 210. However, in embodiments of the 3-D LUT that implements flexible addressing as disclosed herein, the color component values (R', G', B) are determined by a value indicated by a number (m) of MSBs of the complete color component value corresponding to the vertex 210 and a non-zero integer (p).

Each of the vertices 210 is associated with mapped color component values in a second gamut. The color component values associated with the vertices 210 can therefore be used to map input colors in the first gamut to output colors in the second gamut by interpolating from the color component values associated with the vertices 210 to locations indicated by the input color in the first gamut. In some embodiments, tetrahedral interpolation is used to determine an output color by interpolating from four of the vertices 210 to the location of the input color. For example, values of the color components in the second gamut associated with four of the vertices 210 can be interpolated to a location 215 in the cube 205 of the lattice that represents the 3-D LUT. The location 215 is indicated by the color components (R'+r', G'+g', B'+b') of the input color of the first gamut. In a conventional 3-D LUT, the color component values (r', g', b') are equal to the remaining least significant bits (LSBs) of the input color in the first gamut. However, in embodiments of the 3-D LUT that implement flexible addressing as disclosed herein, the color component values (r', g', b') are determined by a value indicated by the number (m) of MSBs of the complete color component value corresponding to the vertex 210 and a non-zero integer (p).

Figure 3:
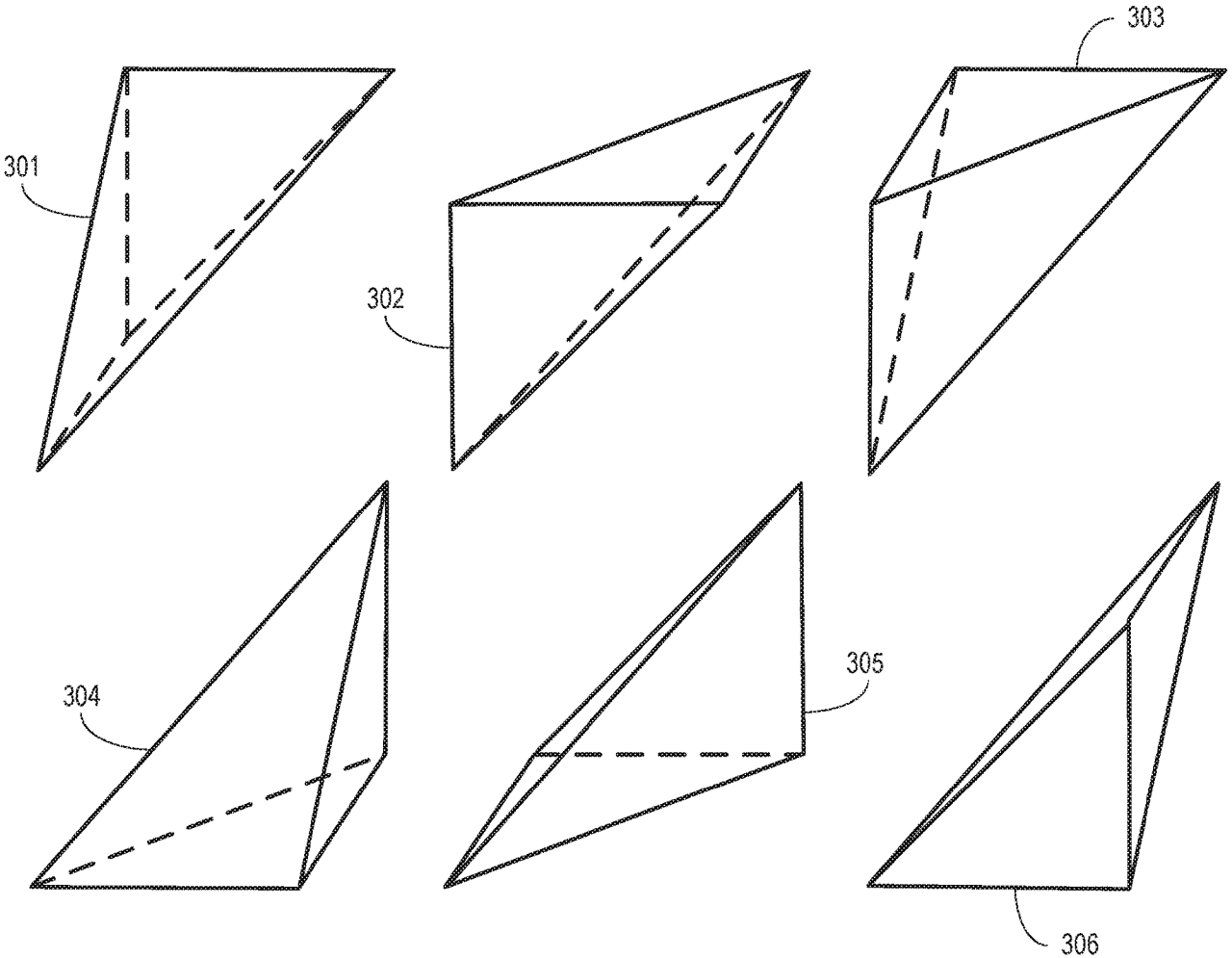
FIG. 3 is a diagram illustrating decomposition of a single cube into six tetrahedrons according to some embodiments.

FIG. 3 is a diagram illustrating decomposition of a single cube into six tetrahedrons 301, 302, 303, 304, 305, 306 according to some embodiments. The six tetrahedrons 301-306 represent some embodiments of the cube 205 shown in FIG. 2. One of the six tetrahedrons 301-306 is selected to perform tetrahedral interpolation based on the location indicated by the component values of the input color. For example, the tetrahedron 301 is selected if the location indicated by the component values of the input color falls within the tetrahedron 301. The values of the color components in the second gamut are then interpolated from the four vertices of the selected one of the six tetrahedrons 301-306 to the location indicated by the color component values of the input color (in the first gamut) to determine the value of the output color.

Figure 4:
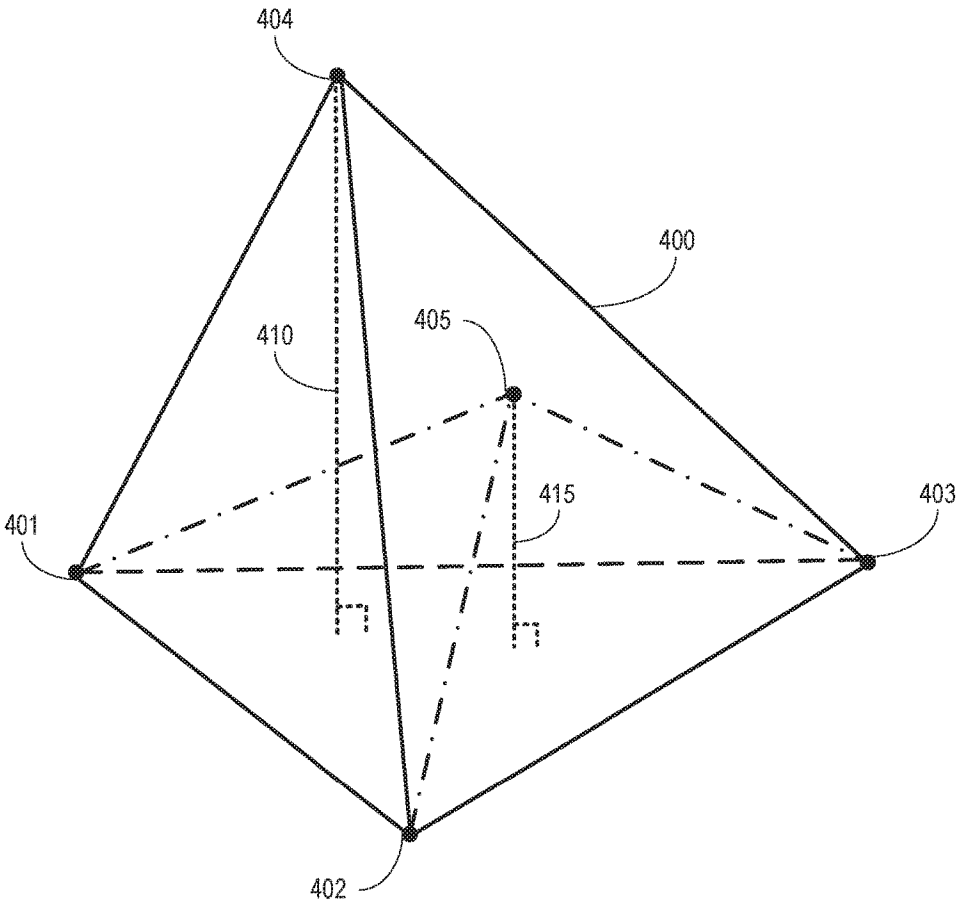
FIG. 4 is a diagram of a tetrahedron used for tetrahedral interpolation according to some embodiments.

FIG. 4 is a diagram of a tetrahedron 400 used for tetrahedral interpolation according to some embodiments. Some embodiments of the tetrahedron 400 represent a selected one of six tetrahedrons that, in combination, represent the cube in the 3-D LUT. For example, the tetrahedron 400 can represent a selected one of the tetrahedrons 301-306 shown in FIG. 3. The tetrahedron 400 has four vertices 401, 402, 403, 404 (collectively referred to herein as "the vertices 401-404") that correspond to vertices in the 3-D LUT. The vertices 401-404 are identified based on a value indicated by a number (m) of MSBs of color component values in a first gamut and a non-zero integer (p), as discussed herein. Each of the vertices 401-404 is also associated with color component values in a second gamut. The vertices 401-404 can also be referred to as the vertices A, B, C, D and the associated color component values in the second gamut can be referred to as $O_A$, $O_B$, $O_C$, $O_D$, respectively.

The interpolated output value for an input color that maps to the input point 405 (also referred to as the input point I) is given by:

$$O_I = \frac{1}{V}(V_A \times O_A + V_B \times O_B + V_C \times O_C + V_D \times O_D)$$

where V is the volume of the tetrahedron 400 and $V_i$(i=A, B, C, D) is the volume for a sub-tetrahedron. For example, $V_D$ is the volume for a sub-tetrahedron bounded by the vertices IABC. The volumes $V_D$ and V share the same bottom surface ABC, and so the above equation can be rewritten as:

$$O_I = \frac{h_A}{H_A} \times O_A + \frac{h_B}{H_B} \times O_B + \frac{h_C}{H_C} \times O_C + \frac{h_D}{H_D} \times O_D$$

where $H_i$(i=A, B, C, D) is the height of the volume V from vertices i respectively and $h_i$(i=A, B, C, D) is the height of the volume $V_i$ from input point I. For example, the height 410 is equivalent to $H_D$ and the height 415 is equivalent to $h_D$. Output weights are defined as:

$$w_i = \frac{h_i \times \Delta}{H_i}$$

where Δ is the length of a side of the cube. The output value $O_1$ can then be written as:

$$O_1=(w_A \times O_A + w_B \times O_B + w_C \times O_C + w_D \times O_D)/\Delta$$

Figure 5:
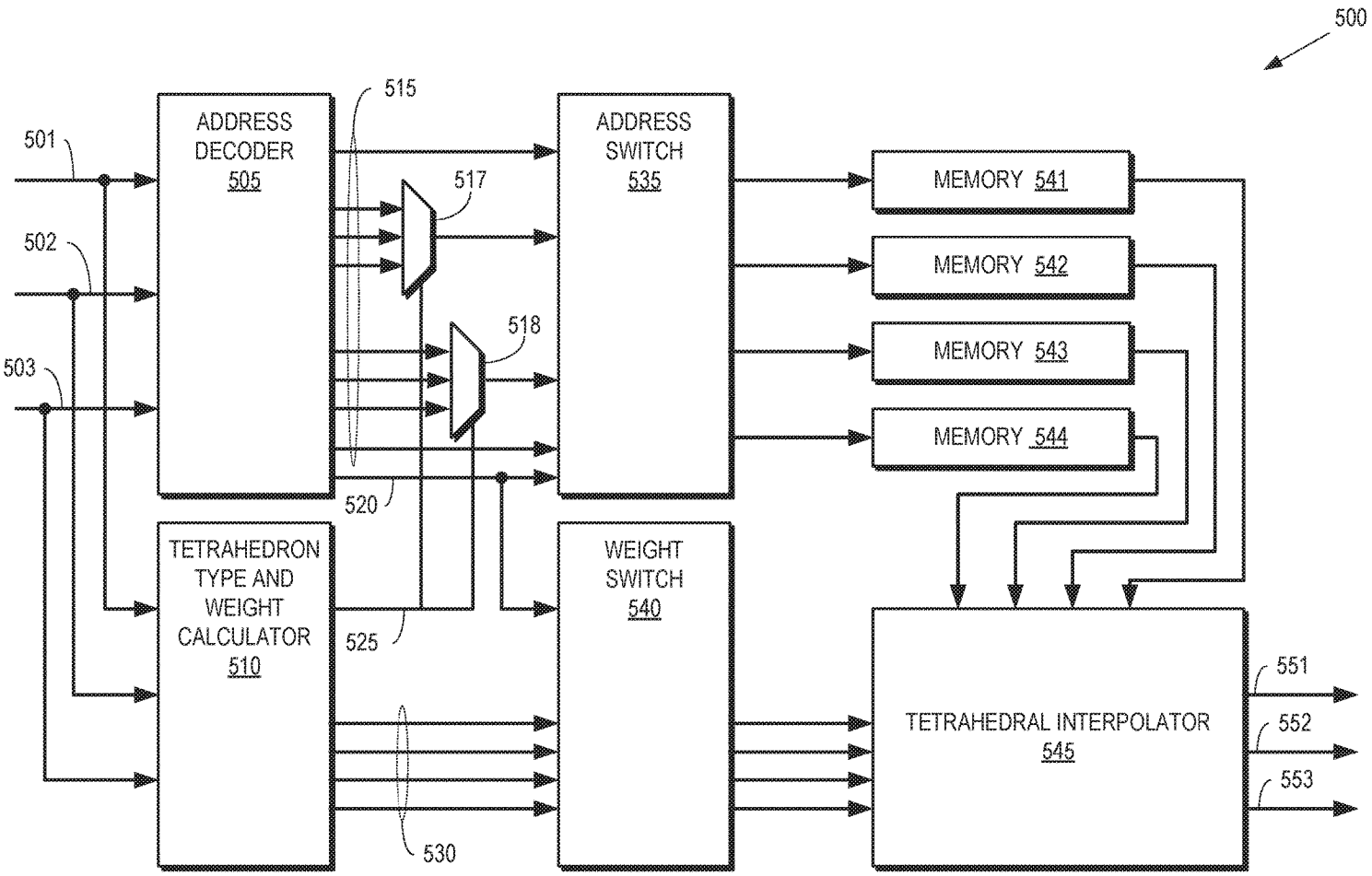
FIG. 5 is a block diagram of a 3-D LUT according to some embodiments.

FIG. 5 is a block diagram of a 3-D LUT 500 according to some embodiments. The 3-D LUT 500 is used to implement some embodiments of the 3-D LUT 120 shown in FIG. 1. The 3-D LUT 500 receives input information representative of values of the color components of an input color in a first gamut. In the illustrated embodiment, the input data includes n-bit values of the color components $R_{in}$, $G_{in}$, $B_{in}$, which are received on the input lines 501, 502, 503, collectively referred to herein as "the input lines 501-503." In the discussion that follows, the m MSBs of the input values of the color components $R_{in}$, $G_{in}$, $B_{in}$ are defined as R, G, B and the (n-m)-bit LSBs of the input values of the color components $R_{in}$, $G_{in}$, $B_{in}$ are defined as r, g, b.

The input values of the color components $R_{in}$, $G_{in}$, $B_{in}$ are provided to an address decoder 505 and a module 510 that determines a type of tetrahedron used for interpolation and calculates weights for the interpolation, as discussed herein. The address decoder 505 generates signals 515 that indicate the vertices of a cube that bound a location of the input color and a subset of the signals 515 are provided to multiplexers 517, 518. The address decoder 505 also generates a signal 520 representative of a type of the 3-D LUT, as discussed herein. The module 510 generates selection signals 525 that are provided to the multiplexers 517, 518 to select the output of the multiplexers 517, 518. The selection signal 525 is determined based on a type of tetrahedron used for interpolation. The module 510 also generates weights 530 that correspond to the type of tetrahedron used for the interpolation.

Signals generated by the address decoder 505 and the multiplexers 517, 518 are provided to an address switch 535 that performs address switching as disclosed herein. Addresses determined by the address switch 535 are used to identify memory locations in the memories 541, 542, 543, 544, which are collectively referred to herein as "the memories 541-544." Values of color components in the second gamut that are associated with the vertices in the 3-D LUT are stored in the memories 541-544. The color component values can be distributed among the memories 541-544 so that interpolation can be performed using values that are retrieved concurrently from the memories 541-544. The signal 520 is also provided to a weight switch 540, which also receives the signals (weights) 530 generated by the module 510. The weight switch 540 performs weight switching as disclosed herein. Signals representative of weights generated by the weight switch 540 are provided to a tetrahedral interpolator 545, which also receives color component values of the vertices of a tetrahedron from the memories 541-544. The tetrahedral interpolator 545 uses the weights and the color component values to generate an output value by tetrahedral interpolation.

Figure 6:
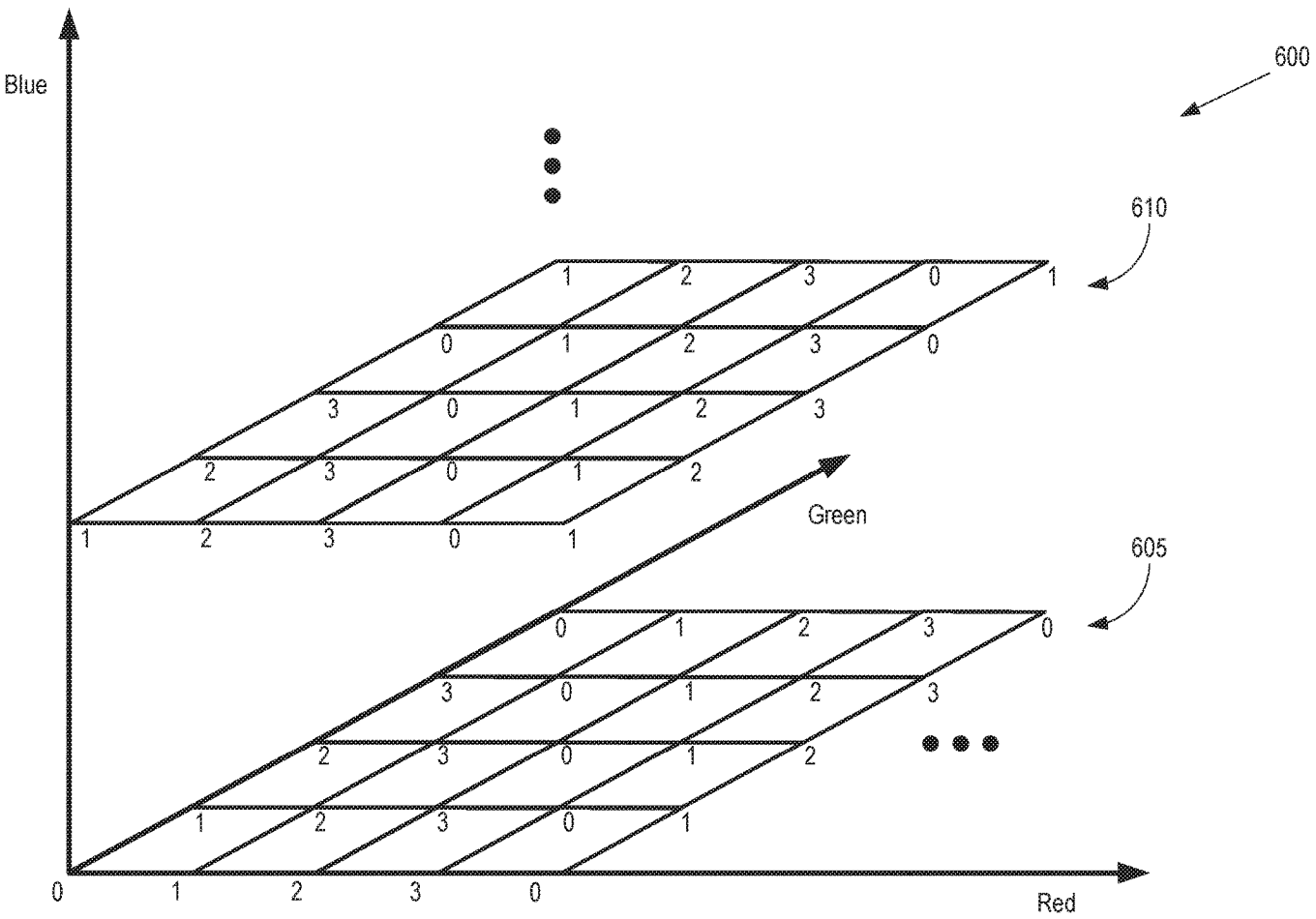
FIG. 6 is a diagram illustrating mapping of vertices of a 3-D LUT to a set of memories according to some embodiments.

FIG. 6 is a diagram illustrating mapping of vertices of a 3-D LUT 600 to a set of memories according to some embodiments. The 3-D LUT 600 corresponds to some embodiments of the 3-D LUT 120 shown in FIG. 1 and the portion 200 of the 3-D LUT shown in FIG. 2. The three component colors in the 3-D LUT 600 are Red, Green, and Blue, which correspond to the axes of the 3-D LUT 600. Input colors in a first gamut can therefore be mapped to locations in the 3-D LUT 600 based on the values of their component colors, as discussed herein. The 3-D LUT 600 includes layers 605, 610 of vertices that correspond to different values of the color components in the Green dimension. Each vertex is associated with values of color components in a second gamut that are mapped to the values of the color components in the first gamut that are mapped to the vertex.

The values of the color components associated with the vertices are stored in four memories such as the memories 541-544 shown in FIG. 5. Each value of the color components associated with the vertex are assigned to one of the memories based on its location in the 3-D LUT 600. In the illustrated embodiment, values of color components associated with the vertices are assigned to memories in a sequence beginning at the lowest values of $R_{in}$, $G_{in}$, $B_{in}$. The sequence increments along the Red axis with fixed values of Green and Blue. For example, the vertex at the lowest, leftmost position is assigned to the memory 0, the vertex having the next higher value in Red is assigned to the memory 1, the vertex having the next higher value in Red is assigned to the memory 2, the vertex having the next higher value in Red is assigned to the memory 3, and the vertex having the next higher value in Red is assigned to the memory 0. The sequence repeats until the end of the Red axis and then loops back to the next higher value in Green and returns to the lowest value in Red. This vertex is assigned to the memory 1. The vertex having the next higher value in Red is assigned to the memory 2 and the sequence repeats until all the vertices at the lowest value in Blue have been assigned to a memory. The sequence then moves to the next higher value in Blue and returns to the lowest values of Red and Green. Assigning the values to the memories according to this sequence allows the vertices of a tetrahedron used for interpolation to be accessed concurrently.

Figure 7:
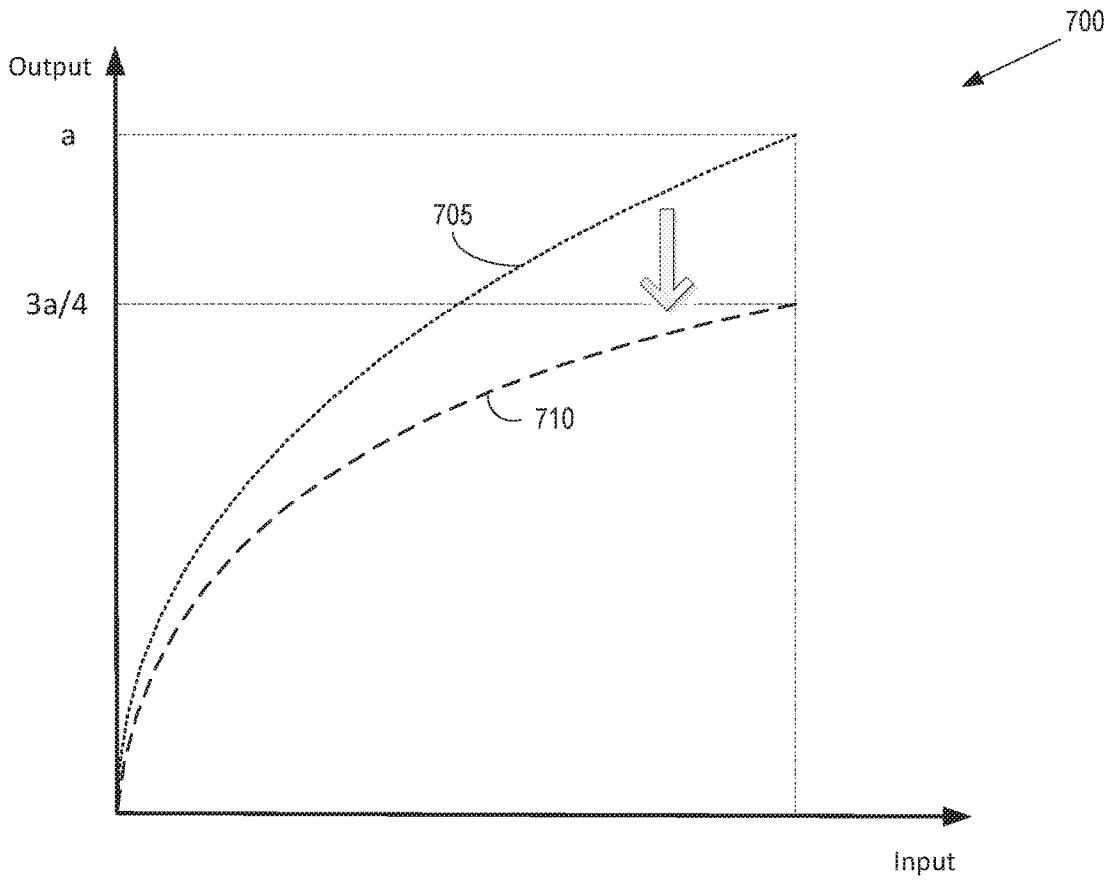
FIG. 7 is a plot illustrating scaling by a first scale factor that is applied to color component values provided to a 3-D LUT that implements flexible addressing according to some embodiments.

FIG. 7 is a plot 700 illustrating scaling by a first scale factor that is applied to color component values provided to the 3-D LUT according to some embodiments. The horizontal axis indicates an input value of a color component and the vertical axis indicates a scaled output value of the color component. For example, the input value of the color component can correspond to an input value of one of the 3-D LUT shapers 121-123 shown in FIG. 1 and the scaled output value of the color component corresponds to an output value of one of the 3-D LUT shapers 121-123 shown in FIG. 1 that has also been scaled to account for flexible addressing. For example, if the 3-D LUT is configured so that vertices are addressed based on a number (m) of most significant bits (MSBs) of color components and a non-zero integer (p), the scale factor λ, is defined as:

$$\lambda = 1 + \frac{p}{2^{m-2}}$$

The number of sampling points along each dimension of the 3-D LUT is $(2^m+1+4p)$ and the non-zero integer (p) satisfies the relationship $(2^m+1+4p)>0$. The first scale factor shown in FIG. 7 corresponds to values of m=4 and p=−1 so that the scale factor λ=3/4. The LUT shaper compresses LUT data 705 by a ratio of 3/4 to produce the scaled LUT data 710.

Figure 8:
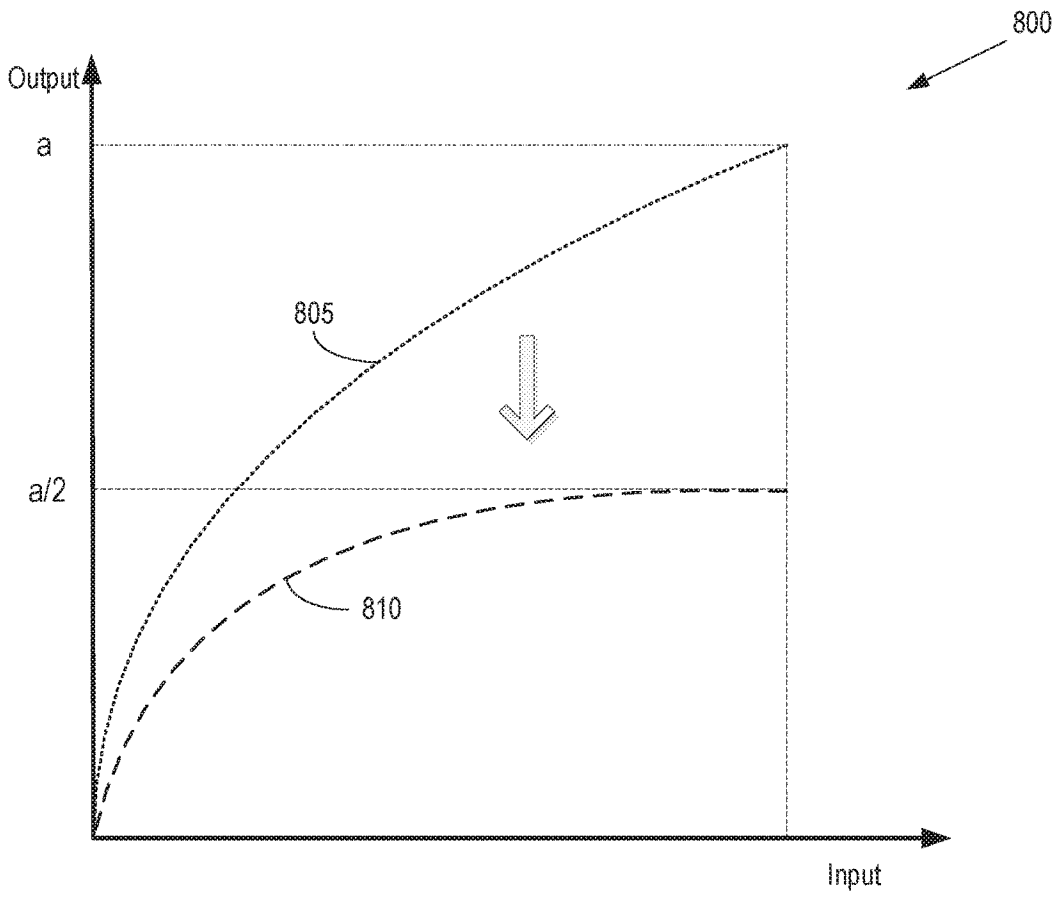
FIG. 8 is a plot illustrating scaling by a second scale factor that is applied to color component values provided to a 3-D LUT that implements flexible addressing according to some embodiments.

FIG. 8 is a plot 800 illustrating scaling by a second scale factor that is applied to color component values provided to the 3-D LUT according to some embodiments. The horizontal axis indicates an input value of a color component and the vertical axis indicates a scaled output value of the color component. For example, the input value of the color component can correspond to an input value of one of the 3-D LUT shapers 121-123 shown in FIG. 1 and the scaled output value of the color component corresponds to an output value of one of the 3-D LUT shapers 121-123 shown in FIG. 1 that has also been scaled to account for flexible addressing. The second scale factor shown in FIG. 8 corresponds to values of m=4 and p=−2 so that the scale factor λ=1/2. This corresponds to configuration 3 described above. When the scale factor is $(1/2)^q$, where q is a integer number, the scaling procedure may not be necessary. In the illustrated embodiment, the LUT shaper compress LUT data 805 by a ratio of 1/2 to produce the scaled LUT data 810. The same scaling is produced in the case of m=3, p=0, so that there is not necessarily any need to do the scaling.

Figure 9:
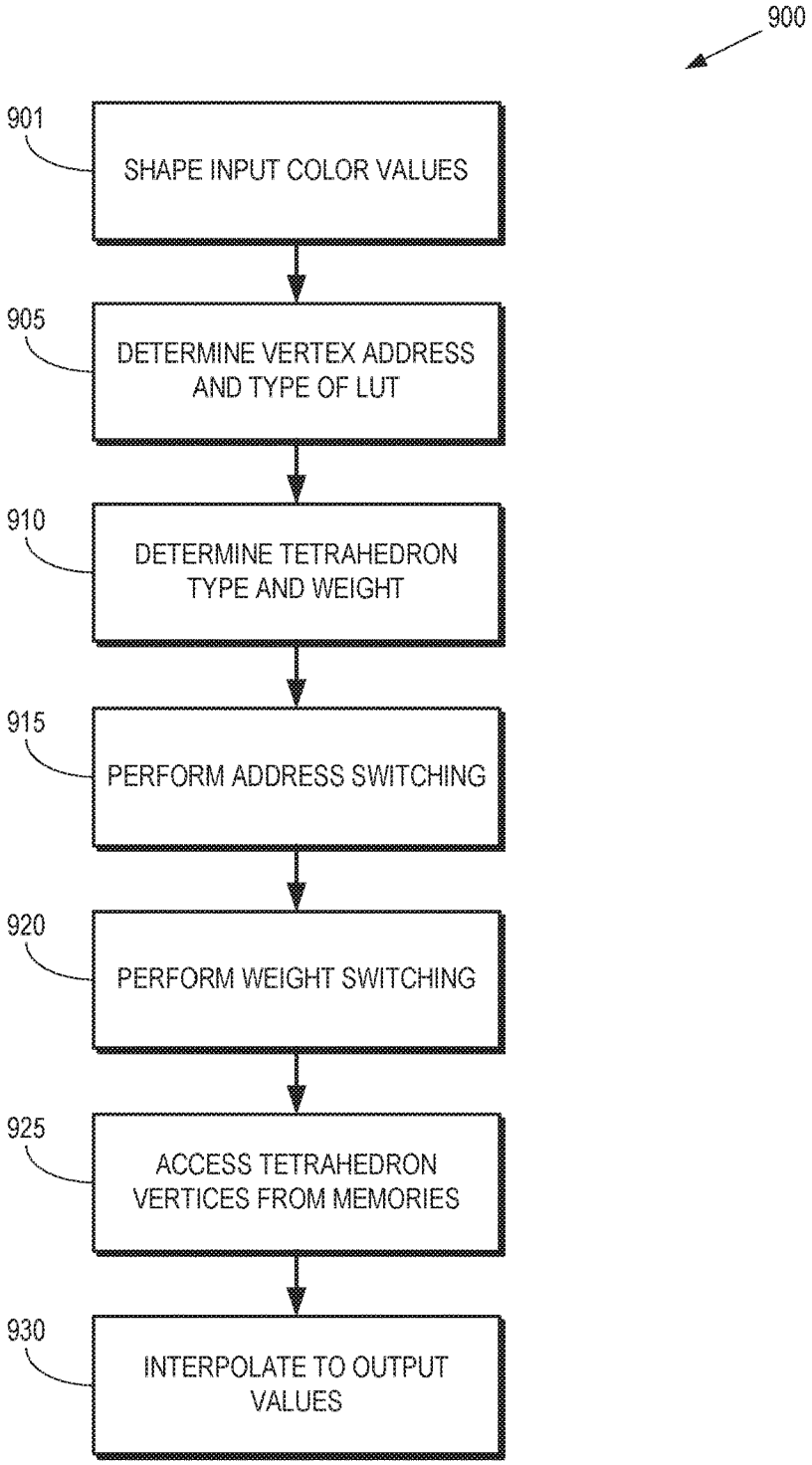
FIG. 9 is a flow diagram of a method of performing tetrahedral interpolation using color component values associated with vertices of a 3-D LUT that uses flexible addressing according to some embodiments.

FIG. 9 is a flow diagram of a method 900 of performing tetrahedral interpolation using color component values associated with vertices of a 3-D LUT that uses flexible addressing according to some embodiments. The method 900 is implemented in some embodiments of the gamut mapper 115 shown in FIG. 1 and the 3-D LUT 500 shown in FIG. 5.

At block 901, one or more LUT shapers such as the 3-D LUT shapers 121-123 shown in FIG. 1 perform shaping of the component values of the input colors that are provided to the 3-D LUT. As discussed herein, shaping the component values for flexible addressing includes applying a scaling factor to the input color components. For example, the component values can be scaled by a factor:

$$\lambda = 1 + \frac{p}{2^{m-2}}$$

At block 905, an address decoder such as the address decoder 505 shown in FIG. 5 determines a vertex address of a vertex in the 3-D LUT and a type of LUT based on a number (m) of most significant bits (MSBs) of color components and a non-zero integer (p). The address decoder also uses the address of the vertex to identify one or more neighboring vertices in the 3-D LUT. Some embodiments of the address decoder determine the vertex addresses by determining a value of a counter based on a number (m) of most significant bits (MSBs) of the input values of the color components:

$$\text{Counter}=(2^m+1)(2^m+1)B+(2^m+1)G+R$$

The value of the counter can also be expressed as:

$$\text{Counter}=(2^{2m}+2^{m+1}+1)B+(2^m+1)G+R$$

A remainder of the counter after division by four is computed:

$$L=rem(\text{Counter},4)$$

Figure 10:
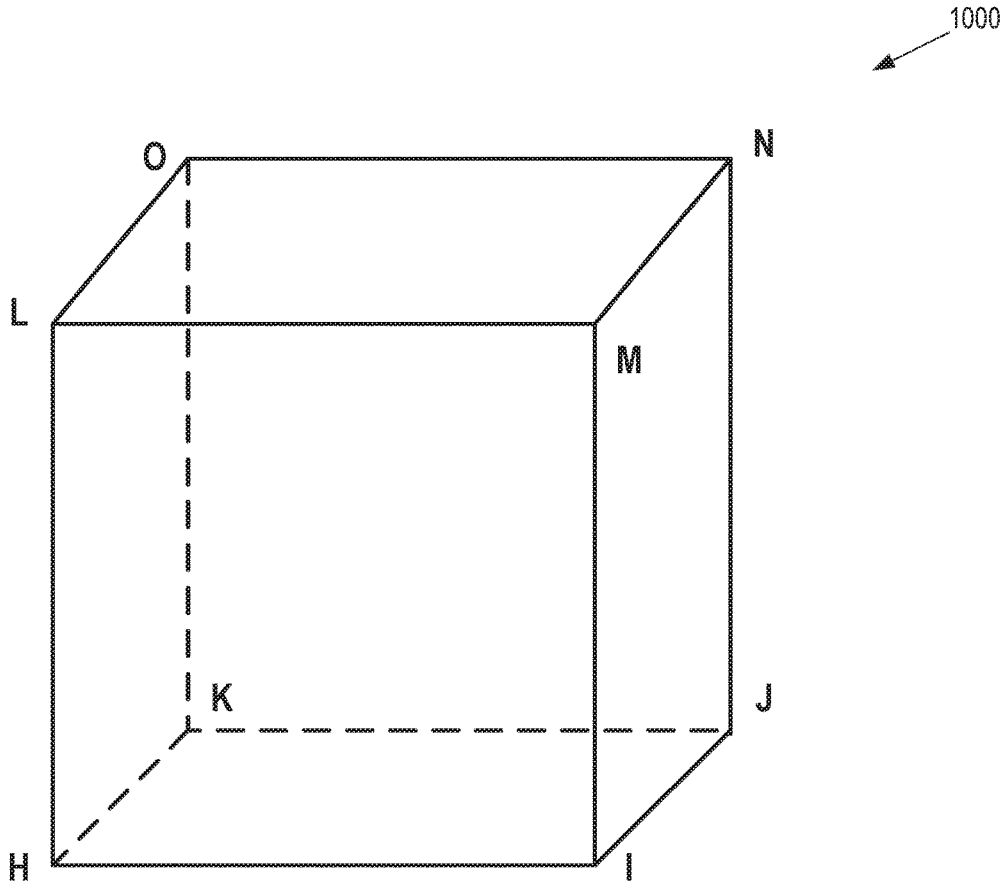
FIG. 10 illustrates a cube that encompasses the location of an input color in a 3-D LUT according to some embodiments.

The vertex addresses of a cube that encompasses the location of the input color are determined based on the counter. The vertices are identified by the letters H, J, K, L, M, N, O, as indicated in FIG. 10, which illustrates a cube 1000 that encompasses the location of an input color in the 3-D LUT according to some embodiments. For example, the cube 1000 can represent some embodiments of the cube 205 that encompasses the location 215 shown in FIG. 2. The vertex addresses are computed as follows:

$$\begin{cases} H = A_B + A_{adj1} \\ I = A_B + \alpha + A_{adj1} \\ J = A_B + 2^{m-2} + \beta + A_{adj2} \\ K = A_B + 2^{m-2} + \alpha + A_{adj2} \\ L = A_B + 2^{2m-2} + 2^{m-1} + \alpha + A_{adj3} \\ M = A_B + 2^{2m-2} + 2^{m-1} + \beta + A_{adj3} \\ N = A_B + 2^{2m-2} + 2^{m-1} + 2^{m-2} + \gamma + A_{adj4} \\ O = A_B + 2^{2m-2} + 2^{m-1} + 2^{m-2} + \beta + A_{adj4} \end{cases}$$

where $A_B$=mod(counter,4) and $$\alpha = \begin{cases} 1 & L == 3 \\ 0 & \text{otherwise} \end{cases},$$

$$\beta = \begin{cases} 1 & L >= 2 \\ 0 & \text{otherwise} \end{cases},$$

$$\gamma = \begin{cases} 1 & L >= 1 \\ 0 & \text{otherwise} \end{cases}$$

$$\begin{cases} A_{adj1} = p \times [G + B \times (2^{m+1} + 2 + 4 \times p)] \\ A_{adj2} = A_{adj1} + p \\ A_{adj3} = A_{adj1} + p \times (2^{m+1} + 2 + 4 \times p) \\ A_{adj4} = A_{adj3} + p \end{cases}$$

Figure 11:
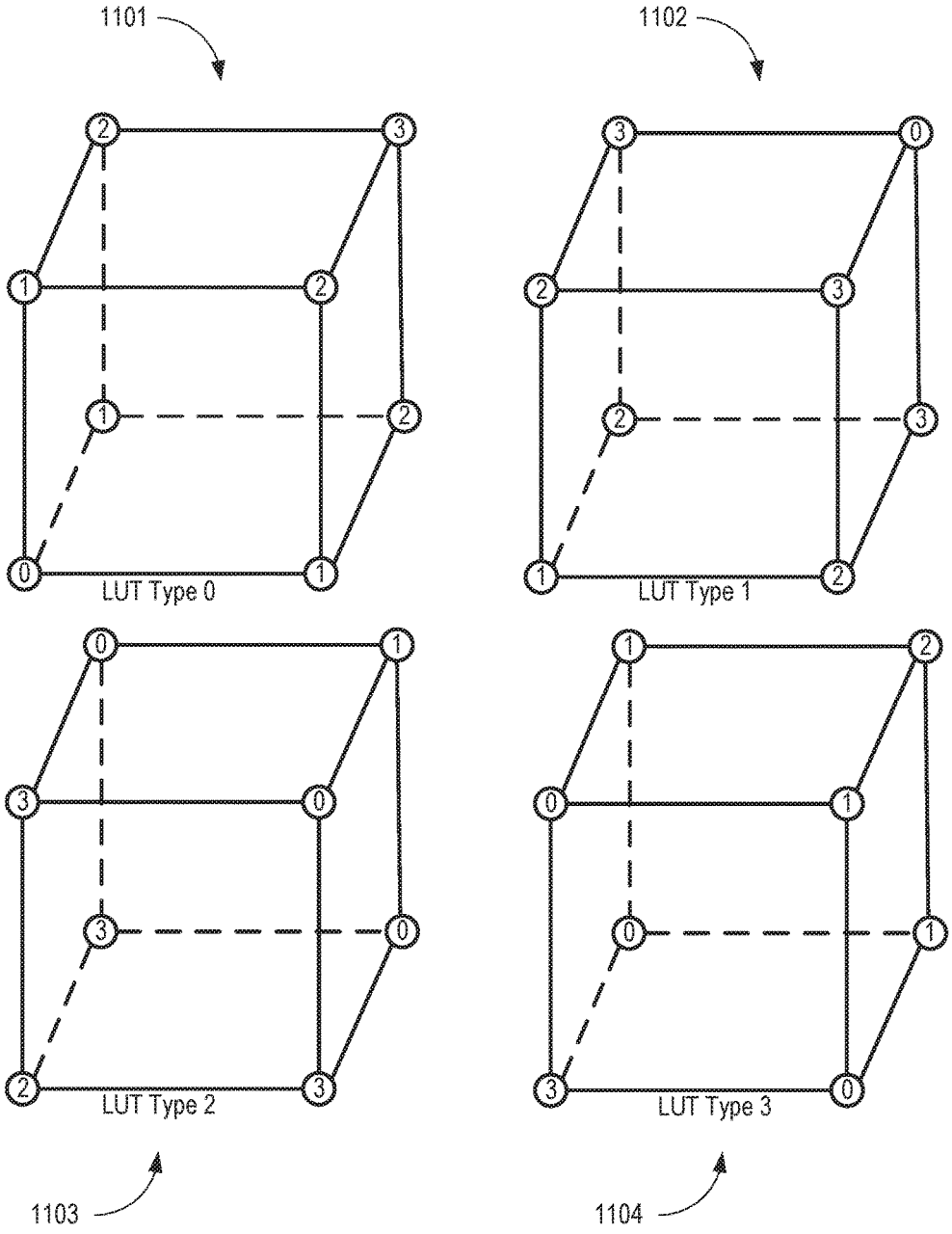
FIG. 11 is a diagram that illustrates a set of LUT types for a set of cubes in a lattice that represent a 3-D LUT according to some embodiments.

The LUT type of the cube that encompasses the input color in the 3-D LUT is determined based on the memories that are used to store the component values associated with the vertices of the cube. FIG. 11 is a diagram that illustrates a set of LUT types for a set of cubes 1101, 1102, 1103, 1104 in a lattice that represent the 3-D LUT according to some embodiments. The numbers (0, 1, 2, 3) in the circles at the vertices of the cubes indicate the four memory elements that are used to store component values and evaluate each of the vertices is stored in the memory element indicated by the corresponding number. For example, the number 0 indicates that the corresponding component value is stored in a first memory such as the memory 541 shown in FIG. 5, the number 1 indicates that the corresponding component value is stored in a second memory such as the memory 542 shown in FIG. 5, the number 2 indicates that the corresponding component value is stored in a third memory such as the memory 543 shown in FIG. 5, and the number 3 indicates that the corresponding component value is stored in a first memory such as the memory 544 shown in FIG. 5. In some embodiments, the component values are stored in the four memories according to the sequence illustrated in FIG. 6.

The different LUT types 0, 1, 2, 3 correspond to different associations of the vertices of the cubes 1101-1104 to the four memories 0, 1, 2, 3. In some embodiments, the LUT type of the cubes 1101-1104 can be determined from the MSBs of the input color using:

$$lut_type = rem(B+G+R,4)$$

At block 910, a module such as the module 510 shown in FIG. 5 determines a type of the tetrahedron used for the interpolation and weights associated with the vertices of the tetrahedron. There are six types of tetrahedron corresponding to the six tetrahedrons 301-306 shown in FIG. 3. The module determines the type of the tetrahedron using the LSBs of the input color:

T0: g>=b>r
T1: b>r>g
T2: b>g>=r
T3: r>=g>b
T4: g>r>=b
T5: r>=b>=g.

The weights ($w_A$, $w_B$, $w_C$, $w_D$) are determined based on the LSBs of the input color and the length Δ of one side of the cube:

$$\Delta = 2^{(n-m)}$$

using the following table:

| tetrahedron | $w_A$ | $w_B$ | $w_C$ | $w_D$ |
|---|---|---|---|---|
| T0 | Δ-g | g-b | b-r | r |
| T1 | Δ-b | b-r | r-g | g |
| T2 | Δ-b | b-g | g-r | r |
| T3 | Δ-r | r-g | g-b | b |
| T4 | Δ-g | g-r | r-b | b |
| T5 | Δ-r | r-b | b-g | g |

At block 915, a module such as the address switch 535 shown in FIG. 5 performs address switching to identify four vertices for the selected tetrahedron from the eight vertices of the cube based on the type of tetrahedron using the following table:

| tetrahedron | Addr_A | Addr_B | Addr_C | Addr_D |
|---|---|---|---|---|
| T0 | H | K | O | N |
| T1 | H | L | M | N |
| T2 | H | L | O | N |

-continued

| tetrahedron | Addr_A | Addr_B | Addr_C | Addr_D |
|---|---|---|---|---|
| T3 | H | I | J | N |
| T4 | H | K | J | N |
| T5 | H | I | M | N |

The addresses are then switched based on the LUT type of the cube using the following table:

| lut_type | Addr0 | Addr1 | Addr2 | Addr3 |
|---|---|---|---|---|
| 0 | Addr_A | Addr_B | Addr_C | Addr_D |
| 1 | Addr_D | Addr_A | Addr_B | Addr_C |
| 2 | Addr_C | Addr_D | Addr_A | Addr_B |
| 3 | Addr_B | Addr_C | Addr_D | Addr_A |

At block 920, a module such as the way to switch 540 shown in FIG. 5 performs weight switching so that the weights match the switched addresses using the following table:

| Lut_type | $w_0$ | $w_1$ | $w_2$ | $w_3$ |
|---|---|---|---|---|
| 0 | $w_A$ | $w_B$ | $w_C$ | $w_D$ |
| 1 | $w_D$ | $w_A$ | $w_B$ | $w_C$ |
| 2 | $w_C$ | $w_D$ | $w_A$ | $w_B$ |
| 3 | $w_B$ | $w_C$ | $w_D$ | $w_A$ |

At block 925, the values of the component colors associated with the tetrahedron vertices are accessed concurrently from the set of memories using the addresses.

At block 930, and interpolator such as the tetrahedral interpolator 545 shown in FIG. 5 uses the values of the component colors associated with the tetrahedron vertices to interpolate to the output values to a location of the input color in the 3-D LUT. For example, the mapping outputs $o_0$, $o_1$, $o_2$, $o_3$ for each of the four vertices can be interpolated to the location of the input color. Each mapping output includes three color components such as Red, Green, and Blue color components in the second gamut. The interpolation output is determined based on the component values and the weights according to:

$$\begin{cases} R_{out} = (w_0 \times o_{R0} + w_1 \times o_{R1} + w_2 \times o_{R2} + w_3 \times o_{R3})/\Delta \\ G_{out} = (w_0 \times o_{G0} + w_1 \times o_{G1} + w_2 \times o_{G2} + w_3 \times o_{G3})/\Delta \\ B_{out} = (w_0 \times o_{B0} + w_1 \times o_{B1} + w_2 \times o_{B2} + w_3 \times o_{B3})/\Delta \end{cases}$$

In some embodiments, the apparatus and techniques described above are implemented in a system comprising one or more integrated circuit (IC) devices (also referred to as integrated circuit packages or microchips), such as the 3-D LUT described above with reference to FIGS. 1-11. Electronic design automation (EDA) and computer aided design (CAD) software tools may be used in the design and fabrication of these IC devices. These design tools typically are represented as one or more software programs. The one or more software programs comprise code executable by a computer system to manipulate the computer system to operate on code representative of circuitry of one or more IC devices so as to perform at least a portion of a process to design or adapt a manufacturing system to fabricate the circuitry. This code can include instructions, data, or a combination of instructions and data. The software instructions representing a design tool or fabrication tool typically are stored in a computer readable storage medium accessible to the computing system. Likewise, the code representative of one or more phases of the design or fabrication of an IC device may be stored in and accessed from the same computer readable storage medium or a different computer readable storage medium.

A computer readable storage medium may include any non-transitory storage medium, or combination of non-transitory storage media, accessible by a computer system during use to provide instructions and/or data to the computer system. Such storage media can include, but is not limited to, optical media (e.g., compact disc (CD), digital versatile disc (DVD), Blu-Ray disc), magnetic media (e.g., floppy disc, magnetic tape, or magnetic hard drive), volatile memory (e.g., random access memory (RAM) or cache), non-volatile memory (e.g., read-only memory (ROM) or Flash memory), or microelectromechanical systems (MEMS)-based storage media. The computer readable storage medium may be embedded in the computing system (e.g., system RAM or ROM), fixedly attached to the computing system (e.g., a magnetic hard drive), removably attached to the computing system (e.g., an optical disc or Universal Serial Bus (USB)-based Flash memory), or coupled to the computer system via a wired or wireless network (e.g., network accessible storage (NAS)).

In some embodiments, certain aspects of the techniques described above may implemented by one or more processors of a processing system executing software. The software comprises one or more sets of executable instructions stored or otherwise tangibly embodied on a non-transitory computer readable storage medium. The software can include the instructions and certain data that, when executed by the one or more processors, manipulate the one or more processors to perform one or more aspects of the techniques described above. The non-transitory computer readable storage medium can include, for example, a magnetic or optical disk storage device, solid state storage devices such as Flash memory, a cache, random access memory (RAM) or other non-volatile memory device or devices, and the like. The executable instructions stored on the non-transitory computer readable storage medium may be in source code, assembly language code, object code, or other instruction format that is interpreted or otherwise executable by one or more processors.

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. A method comprising:

identifying a plurality of vertices in a three-dimensional (3-D) look up table (LUT) based on a number (m) of most significant bits (MSBs) of three coordinate values representative of an input color and a non-zero integer (p), wherein the three coordinate values are determined by a source gamut;

retrieving component values representative of a plurality of second colors determined by a destination gamut, wherein the component values are stored at memory locations associated with the plurality of vertices;

scaling the component values in the source gamut by a factor determined by the non-zero integer (p); and mapping the input color to an output color in the destination gamut based on the component values, wherein a number of vertices along each dimension of the 3-D LUT is equal to $(2^m+1+4p)$.

2. A method comprising:

identifying a plurality of vertices in a three-dimensional (3-D) look up table (LUT) based on a number (m) of most significant bits (MSBs) of three coordinate values representative of an input color and a non-zero integer (p), wherein the three coordinate values are determined by a source gamut;

retrieving component values representative of a plurality of second colors determined by a destination gamut, wherein the component values are stored at memory locations associated with the plurality of vertices, scaling the component values in the source gamut by a factor determined by the non-zero integer (p); and mapping the input color to an output color in the destination gamut based on the component values, wherein the component values are scaled by a factor of $$\lambda = 1 + \frac{p}{2^{m-2}}$$

relative to corresponding component values for a 3-D LUT having a number of vertices along each dimension that is equal to $(2^m+1)$.

3. The method of claim 2, wherein identifying the plurality of vertices comprises:

identifying one vertex based on the number (m) of most significant bits (MSBs) of the three coordinate values representative of the first color and the non-zero integer (p); and identifying neighbor vertices in the 3-D LUT based on the vertex identified using the number (m) of most significant bits (MSBs) of the three coordinate values representative of the first color and the non-zero integer (p).

4. The method of claim 3, wherein mapping the input color to the output color comprises interpolating component values retrieved from the memory locations associated with the plurality of vertices to the input color.

5. The method of claim 4, wherein the plurality of vertices comprises four vertices, and wherein mapping the input color to the output color comprises performing tetrahedral interpolation of the component values received from the four memory locations to a value of the input color.

6. The method of claim 5, wherein retrieving the component values from the memory locations comprises concurrently retrieving the component values from four memories.

7. An apparatus comprising:

an address decoder to identify a plurality of vertices in a three-dimensional (3-D) look up table (LUT) based on a number (m) of most significant bits (MSBs) of three coordinate values representative of a first color and a non-zero integer (p), wherein the three coordinate values are determined by a source gamut;

at least one memory to store component values representative of a plurality of second colors determined by a destination gamut, wherein the component values are stored at memory locations associated with the plurality of vertices;

a shaper to scale the component values in the source gamut by a factor determined by the non-zero integer (p); and an interpolator to map the input color to an output color in the destination gamut based on the component values, wherein a number of vertices along each dimension of the 3-D LUT is equal to $(2^m+1+4p)$.

8. An apparatus comprising:

an address decoder to identify a plurality of vertices in a three-dimensional (3-D) look up table (LUT) based on a number (m) of most significant bits (MSBs) of three coordinate values representative of a first color and a non-zero integer (p), wherein the three coordinate values are determined by a source gamut at least one memory to store component values representative of a plurality of second colors determined by a destination gamut, wherein the component values are stored at memory locations associated with the plurality of vertices;

a shaper to scale the component values in the source gamut by a factor determined by the non-zero integer (p); and an interpolator to map the input color to an output color in the destination gamut based on the component values, wherein the component values are scaled by a factor of $$\lambda = 1 + \frac{p}{2^{m-2}}$$

relative to corresponding component values for a 3-D LUT having a number of vertices along each dimension that is equal to $(2^m+1)$.

9. The apparatus of claim 8, wherein the address decoder is configured to identify one vertex based on the number (m) of most significant bits (MSBs) of the three coordinate values representative of the first color and the non-zero integer (p).

10. The apparatus of claim 9, further comprising:

a first module to determine a type of tetrahedron based on least significant bits (LSBs) of the three coordinate values representative of a first color, wherein the LSBs do not include the MSBs of the three coordinate values.

11. The apparatus of claim 10, further comprising:

a second module to identify three neighbor vertices in the 3-D LUT based on the type of tetrahedron and the vertex identified using the number (m) of most significant bits (MSBs) of the three coordinate values representative of the first color and the non-zero integer (p).

12. The apparatus of claim 11, further comprising:

four memories to store component values retrieved from the vertex and the three neighbor vertices in the 3-D LUT.

13. The apparatus of claim 12, wherein the interpolator is a tetrahedral interpolator that is configured to map the input color to the output color by performing tetrahedral interpolation of the component values received from the four memory locations to a value of the input color.

14. The apparatus of claim 13, wherein the tetrahedral interpolator is configured to concurrently retrieve the component values from four memories.

15. A method, comprising:

generating samples of component values of output colors determined by a first gamut based on three values representative of corresponding input colors determined by a second gamut, wherein the three values representative of the corresponding input colors are determined along three coordinates of a color system, and wherein the number of samples along each of the three coordinates is defined by a number (m) of most significant bits (MSBs) of the input colors and a non-zero integer (p) , wherein the number of samples along each dimension of the color system is equal to $(2^m+1+4p)$; and storing the samples of the component values in at least one memory.

16. The method of claim 15, further comprising:

scaling the component values by a factor of $$\lambda = 1 + \frac{p}{2^{m-2}}$$

relative to corresponding component values having a number of samples along each dimension that is equal to $(2^m+1)$.

17. The method of claim 15, wherein storing the samples of the component values comprises storing the samples of the component values in four memories in a sequence that allows at least four samples of eight samples that define a cube in the three coordinates of the color system to be accessed concurrently.

* * * * *